US009022130B2

(12) United States Patent
Telfer

(10) Patent No.: US 9,022,130 B2
(45) Date of Patent: May 5, 2015

(54) DOWNHOLE VALVE TOOL AND METHOD OF USE

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 793 days.

(21) Appl. No.: 13/264,341

(22) PCT Filed: Apr. 12, 2010

(86) PCT No.: PCT/EP2010/054760
§ 371 (c)(1),
(2), (4) Date: Nov. 15, 2011

(87) PCT Pub. No.: WO2010/119010
PCT Pub. Date: Oct. 21, 2010

(65) Prior Publication Data

US 2012/0055681 A1 Mar. 8, 2012

(30) Foreign Application Priority Data

Apr. 16, 2009 (GB) ..... 0906522.8

(51) Int. Cl.
*E21B 34/10* (2006.01)
*E21B 34/08* (2006.01)
*E21B 34/00* (2006.01)

(52) U.S. Cl.
CPC ..... *E21B 34/08* (2013.01); *E21B 34/10* (2013.01); *E21B 34/102* (2013.01); *E21B 34/103* (2013.01); *E21B 2034/007* (2013.01)

(58) Field of Classification Search
CPC ..... E21B 47/1025
USPC ..... 166/250.17, 319, 334.1, 373, 386
See application file for complete search history.

(56) References Cited

U.S. PATENT DOCUMENTS 3,148,731 A * 9/1964 Holden ..... 166/141
3,965,980 A * 6/1976 Williamson ..... 166/321

(Continued)

FOREIGN PATENT DOCUMENTS

GB 2 279 385 A 1/1995
GB 2 314 106 A 12/1997
GB 2 448 632 A 10/2008

OTHER PUBLICATIONS

Search Report issued in related British Application No. GB0906522.8; Dated Aug. 17, 2009 (1 page).

(Continued)

*Primary Examiner* — David Andrews
*Assistant Examiner* — Richard Alker
(74) *Attorney, Agent, or Firm* — Osha Liang LLP

(57) ABSTRACT

A downhole isolation valve for testing the integrity of a tubular within a wellbore includes a tubular body with an axial through bore having a reduced diameter portion defining a valve seat and a ledge; an inner sleeve, with a closed end configured to seal within the valve seat, a shoulder spaced from that closed end, and a radial outlet positioned between the shoulder and the closed end; wherein in use the inner sleeve is selectively moveable within the bore at a predetermined pressure between a closed position, in which there is no flowpath through the bore, and an open position, in which the closed end is positioned beyond the valve seat to expose the radial outlet to the through bore beyond the valve seat and provide a flowpath through the bore of the outer tubular body.

25 Claims, 3 Drawing Sheets

(56) References Cited

U.S. PATENT DOCUMENTS

| | | | | |
|---|---|---|---|---|
| 5,044,444 | A | 9/1991 | Coronado | |
| 5,518,073 | A | 5/1996 | Manke et al. | |
| 6,125,930 | A * | 10/2000 | Moyes | 166/66 |
| 6,325,151 | B1 | 12/2001 | Vincent et al. | |
| 6,397,949 | B1 | 6/2002 | Walker et al. | |
| 8,590,629 | B2 * | 11/2013 | Swietlik et al. | 166/386 |
| 2001/0007284 | A1 | 7/2001 | French et al. | |
| 2003/0132007 | A1 | 7/2003 | Howlett et al. | |
| 2003/0221830 | A1 | 12/2003 | Leising et al. | |
| 2004/0094304 | A1 | 5/2004 | Turner et al. | |

OTHER PUBLICATIONS

International Search Report from PCT/EP2010/054760 dated Oct. 19, 2010 (3 pages).

Written Opinion from PCT/EP2010/054760 dated Oct. 19, 2010 (7 pages).

UK Office Action for GB Application No. GB0906522.8 dated Aug. 18, 2009 (3 pages).

* cited by examiner

DOWNHOLE VALVE TOOL AND METHOD OF USE

FIELD OF THE INVENTION

The present invention relates to a downhole isolation valve useful in the oil and gas exploration and production industry. The present invention also relates to use thereof downhole in conjunction with a tubular work string e.g. in a method of testing the integrity of an end of a liner or casing string of a wellbore.

BACKGROUND TO THE INVENTION

Oil and gas is recovered by drilling into a hydrocarbon-bearing formation, for which purpose a drillstring terminated by a drill bit is used to form a wellbore. The drillstring formed from a series of connected drill pipe stands is rotated to remove formation ahead of the drill bit. Drilling mud or other fluid is pumped through the drillstring to cool the drill bit, and to aid the passage of drill cuttings from the base of the well to the surface, via an annulus formed between the drillstring and the wall of the wellbore.

Drilling operations may be hampered if the borehole formed by drilling is unstable. Typically, at predetermined intervals, the drillstring is pulled out of the bore hole, the bit is removed from the wellbore and a casing for the borehole comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a downhole liner comprising similar tubular sections coupled together end-to-end may be installed in the well, fastened to and extending from the final casing section. The downhole liner may, or may not be, slotted or perforated.

The liner is typically supported upon the lower casing tubulars by use of a liner hanger and associated packer which provides an endurable seal between the casing and liner which must be capable of remaining fully functional downhole for many years. Before the packer can be set the positioned liner must be hung off upon the liner hanger. The liner hanger supports the full weight of the liner and maintains its position whilst the liner top packer seals are set. Since the operation is conducted deep downhole, it is not possible to inspect the operation directly, and so the success or otherwise of the setting operation has to be deduced by other means. For example it is important to gauge the integrity of the seals formed around the liner top, and to verify that the installed casing and liner tubulars form a fluid-tight circulation path and in particular to check that there is no leak associated with the liner hanger or the liner hanger packer.

The liner hanger usually provides for pressure sealing the hanger joint to the intent that the tubular bore passing through the casing into the liner is isolated from the annulus around the casing and liner within the borehole.

Since equipment for circulating fluids under pressure is routinely used on site, it is a known technique to utilise fluid pressure differentials downhole to predict or surmise conditions at a selected location around or within the tubular casing/liner extended length.

Thus pressure testing of the integrity of the liner top hanger seal is achievable by sealing the liner entry region with a removable seal (packer) being positioned within the annulus between a run-in tubular work string and a selected region of the internal wall of the liner.

In one such technique at least one packer is inserted into the well bore to seal off a portion of the annulus between the work string and the liner within the well bore just above the liner hanger. Fluid within the work string is displaced and a relatively low density fluid in comparison with the fluid already present in the wellbore is introduced to the work string thereby reducing hydrostatic pressure within the tubular string length. As a consequence of the pressure differential created, (assuming a sound packer seal) any imperfections in the liner hanger seals will admit overhead well bore circulation fluid resulting in an increase in pressure which can be monitored and used as an indication that liner top seal repairs are necessary.

A tool suitable for such a testing procedure is described in U.S. Pat. No. 6,896,064, which is hereby incorporated by reference.

That tool is adapted for mounting on a work string, and comprises a body with one or more packer elements and a sleeve, wherein the sleeve has or is associated with a shoulder and is moveable in relation to the tool body, wherein the shoulder co-operates with a formation, wherein upon co-operation with the formation, the sleeve can be moved relative to the tool body by setting down weight on the tool, and wherein movement of the sleeve relative to the tool body compresses the one or more packer elements.

The tool run into a pre-formed well bore on the work string. The pre-formed well bore is lined by a casing string and liner. The packer tool is run through the bore until the shoulder rests on the top of the liner. Weight is then set down on the work string and attached tool, until the one or more shear pins, shear.

Shearing of the shear pins, releases the sleeve from the body of the tool, and allows the sleeve to be moved relative to the body, by virtue of further weight set on the tool. Such shearing of the shear pins allows the sleeve to move in an axial direction relative to the body, whereby it compresses the one or more squeezable packer elements. Compression of the packer elements distorts them from an axially aligned oblong shape to a squat, radially extending squared shape. As a result of the change in configuration of the packer elements these come into contact with the casing thereby sealing the annulus between the casing and the tool.

Upon setting the packer tool an inflow negative test can be carried out to check the integrity of, for example, the cement bonds between tubular members and between casing connections. The test involves increasing pressure in the annulus above the packer (and liner top seal under test).

In order to achieve this, the work string can be filled with water or a similar low density fluid. This lower density fluid exerts a lower hydrostatic pressure within the drill pipe than the drilling fluid which is usually circulated through the pipe. If there are any irregularities in the cement bonds between casing members in the well bore, the drop in hydrostatic pressure created by circulation of a low density fluid will allow well bore fluids to flow into the bore lining. If this occurs an increase in pressure is recorded within the bore. This can be achieved by opening the drill pipe at the surface and monitoring for an increase in pressure which will occur if fluid flows into the bore. This allows any irregularities in the bore lining to be identified.

Such a technique is useful whenever it is possible to displace the existing wellbore fluid and create a pressure differential by introducing a fluid that is lighter than the fluid already present in the well bore.

SUMMARY OF THE INVENTION

An object of the invention is to provide a tool useful in pressure testing of tubulars and associated components for installing said tubulars in a bore hole and to provide a method of testing using such a tool.

According to a first aspect of the present invention there is provided a tubular isolation valve comprising:

an outer tubular body adapted to attach to a work string, the outer tubular body having an axial through bore; and an inner sleeve, located within the bore of the outer tubular body; wherein the inner sleeve is selectively moveable axially within the bore relative to the outer tubular body between a closed position, in which there is no flowpath through the bore of the outer tubular body, and an open position, in which the tubular isolation valve provides a flowpath through the bore of the outer tubular body, wherein said inner sleeve is moveable at a predetermined pressure.

The inner sleeve has an end configured to seal within a valve seat located within the bore of the outer tubular body. The valve seat may comprise a bore constriction in the outer tubular body. The valve seat may include a circumferential bevelled surface upon a shoulder forming the bore constriction in the outer tubular body to facilitate entry of the inner sleeve end into the constriction in a close fitting configuration. The seal between said inner sleeve end and the bore constriction may include one or more O-rings.

A tubular isolation valve according to a preferred embodiment of the invention comprises an outer tubular body adapted to attach to a work string, the outer tubular body having an axial through bore, said through bore having a reduced diameter portion defining a valve seat and a ledge; and an inner sleeve, located within the bore of the outer tubular body, and having a closed end configured to seal within the valve seat, and a shoulder spaced from that closed end, and having a radial outlet in the sleeve positioned between the shoulder and the closed end;

wherein in use the inner sleeve is selectively moveable axially within the bore relative to the outer tubular body between a closed position, in which said closed end is in sealing abutment with the valve seat, and the shoulder is spaced from the ledge, and there is no flowpath through the bore of the outer tubular body, and an open position, in which the shoulder is in abutment with the ledge, and the closed end is positioned beyond the valve seat to expose the radial outlet to the throughbore beyond the valve seat, whereby the tubular isolation valve provides a flowpath through the bore of the outer tubular body, and wherein said inner sleeve is moveable at a predetermined pressure Optionally, the inner sleeve has a leading end having a blind bore plug which is locatable within the bore constriction to close the bore, and at least one radial outlet is located in the inner sleeve towards that end. The position of the radial outlet(s) is such that when the tubular isolation valve is closed, flow through the radial outlet(s) is not possible, but upon opening of the tubular isolation valve, the movement of the inner sleeve end beyond the valve seat, causes the radial outlet(s) to be repositioned in the bore to admit fluid flow.

Optionally, the tubular isolation valve includes at least one shear pin, which holds the inner sleeve fixed relative to the outer tubular body in the closed position and which is shearable to allow the inner sleeve to move to the open position at said predetermined pressure.

Typically, the shear pin is arranged to be sheared in response to fluid pressure acting on the inner sleeve.

Typically at least one side port is provided in the outer tool body to admit fluid pressure from the annulus around the string in use to cause release of the inner sleeve from its closed position, and move it to the open position to thereby open flow communication through the string.

Typically, the inner sleeve has a shoulder on a surface thereof, and the radial outlet is located between the closed one end of the inner sleeve and said shoulder of the inner sleeve.

Typically, the outer tubular body has a corresponding ledge configured to abut the shoulder of the inner sleeve when the tubular isolation valve is in the open position. In this way the extent of axial movement of the inner sleeve is predetermined and limited.

Optionally, the ledge comprises a reduced diameter portion of the bore of the outer tubular body, and the shoulder is provided by an increased diameter portion of the inner sleeve.

Typically, when the inner sleeve is in the closed position, the radial outlet is located between the shoulder of the inner sleeve and the seat of the outer tubular body, and in the open position, the radial outlet is located past the seat and opening into a further section of bore of the outer tubular body.

Typically, in the closed position, a seal is located between the inner sleeve and the seat to prevent fluid flow around the outside of the inner sleeve and past the seat. The seal may comprise one or more O-rings.

Optionally, the tubular isolation valve also includes an inner sleeve retaining pin, which is located adjacent to the outer surface of the inner sleeve and is spring biased in a radially inwards direction towards the inner sleeve.

Optionally, the inner sleeve includes a recess in its outer surface, the recess being axially aligned with the inner sleeve retaining pin in the open position, such that, when the open position is reached, the inner sleeve retaining pin is spring urged into engagement with the recess, thereby retaining the inner sleeve in the open position. Thus the inner valve sleeve may be locked in the open position to prevent malfunction should the work string need to be worked, e.g. reciprocated and/or rotated, after the valve is opened.

Optionally, the tubular isolation valve also includes an intermediate sleeve that is fixed to the outer tubular body.

Optionally, the intermediate sleeve engages a shoulder of the inner sleeve when the inner sleeve is in the closed position.

Optionally, the inner sleeve retaining pin is located within a retaining pin socket of the intermediate sleeve, the retaining pin of the intermediate sleeve permanently fixing the intermediate sleeve to the outer tubular body.

According to a second aspect of the present invention there is provided a method of testing the integrity of a seal between a liner top and a casing string of a wellbore, comprising the steps of:

providing a tubular string including a tubular isolation valve and a settable liner test tool including a packer;

running the tubular string into the wellbore with the tubular isolation valve in a closed position in which there is no flowpath through the bore of the tubular isolation valve;

closing the annulus of the wellbore between the tubular string and the casing or liner to allow the seal to be tested; and pressurising annulus above the seal to be tested using a fluid, and using pressure developed in the annulus to open the isolation valve and establish a flowpath through the tubular into the annulus below the seal to be tested.

In this way, the integrity of the seal under test may be determined by monitoring fluid pressure changes. Assuming that the packer is performing its function, any fluid inflow from the annulus must be indicative of a poor liner top seal.

Optionally, the method may comprise the step of introducing a first fluid of predetermined properties into a tubular bore section above the tubular isolation valve. This may be a gaseous fluid such as air achievable by simply running the tool in "dry", or a predetermined amount of a working fluid and air, based upon negative test calculations for the job at hand.

The fluid to be optionally introduced upon run in of the tool may be a predetermined mixture of air and another fluid e.g. a working fluid such as a circulation or drilling fluid. After the negative or inflow test has been conducted according to prescribed specifications, the pressure can be equalised about the seal by filling the tubular with a fluid e.g. drilling mud, and pressuring up to normal drilling/circulation pressures.

The packer tool can be unset and withdrawn, e.g. by picking up the tubular string where the packer is a weight set packer. However, the invention is not limited to use with weight-set packers. Other types of packers are available as is already known in the art.

Preferably, the tubular isolation valve adopted in the aforesaid method of the invention is a tool that comprises the features of the first aspect of the invention.

Typically, the annulus around the tubular string within the liner of the wellbore is sealed by a packer at or above a liner hanger.

Typically, for pressurisation the annulus of the wellbore is sealed at surface by a BOP, and at the liner by a packer carried by a tubular sub.

Typically, the tubular string is a drillstring.

According to a third aspect of the invention, there is provided a test assembly comprising an isolation valve and a packer tool assembled in a workstring in an operable combination for use in a wellbore, for the purposes of performing an inflow or negative test in a wellbore, wherein the isolation valve is introduced to the well bore in a closed or "no go" condition, whereby flow through the workstring is obstructed.

In a suitable test assembly the packer is of the weight set type, which is actuable by the setting down or pick up of the work string.

The work string may be a drillstring, and the isolation valve may be actuated by fluid pressure delivered through a wall of the drillstring from the annulus around the drillstring in use in a wellbore.

According to a fourth aspect of the invention there is provided a method of pressure testing the integrity of a downhole liner top assembly in a well bore using a workstring including a tool assembly having a throughbore and comprising an isolation valve adapted to close the throughbore and a packer, the method comprising the steps of running the tool assembly with the isolation valve in a closed position into the well bore to the liner top assembly to be tested, positioning and setting the packer to close the annulus within the well bore and around the workstring, and increasing fluid pressure above the packer to cause opening of the isolation valve and permit fluid flow in the throughbore.

In an embodiment of the method, the workstring is a drill string which includes a liner top test tool equipped with means for setting the liner top test tool at the liner top, and the drillstring section incorporating the isolation valve is run in hole dry (i.e. without circulation fluid or mud within it) and closed so that there is no fluid communication with the drill string below. After the liner top test tool is set, the pressure in the annulus around the tool and above the liner top under test is increased, and the isolation valve opens to restore flow communication. The effect is to create significant draw-down upon the liner top, and permits a more reliable evaluation of the liner top integrity and its capacity to withstand future operational conditions.

The work string may also include a side entry sub with valve means and pressure evaluation means. The valve may be a needle valve. A pressure gauge may be attached to the work string at the surface (topside) and means may be provided for bleeding off gas and monitoring set-up for conducting the negative or inflow test. A simple but reliable means for assessing set-up for the test may include a bleed line (hose) connected at one end to the valve and having a free end immersed in a fluid at surface whereby returning gas bubbles can be observed. A successful test is established when the return air flow ceases (no bubbles observed) since this is indicative of no inflow through the seal under test.

Features of the first aspect of the invention may be utilised in the second, third and fourth aspects of the invention and any embodiment thereof.

BRIEF DESCRIPTION OF THE DRAWINGS

An embodiment of the invention will now be described, by way of example only, and with reference to the following drawings, in which: —

FIG. 1 shows a tubular isolation valve 10 in the form of a sub insertable in a drillstring. The drillstring isolation valve 10 includes an outer tubular body 12 that is adapted to attach to a drillstring (not shown) by conventional pin and box joints. The outer tubular body 12 has an upper end 12U, a lower end 12L and has a bore 14 therethrough. The body has an annulus-pressure inlet port 23 configured to admit fluid pressure to an expansion chamber 27 to actuate the valve in a manner to be explained below.

Figure 1:
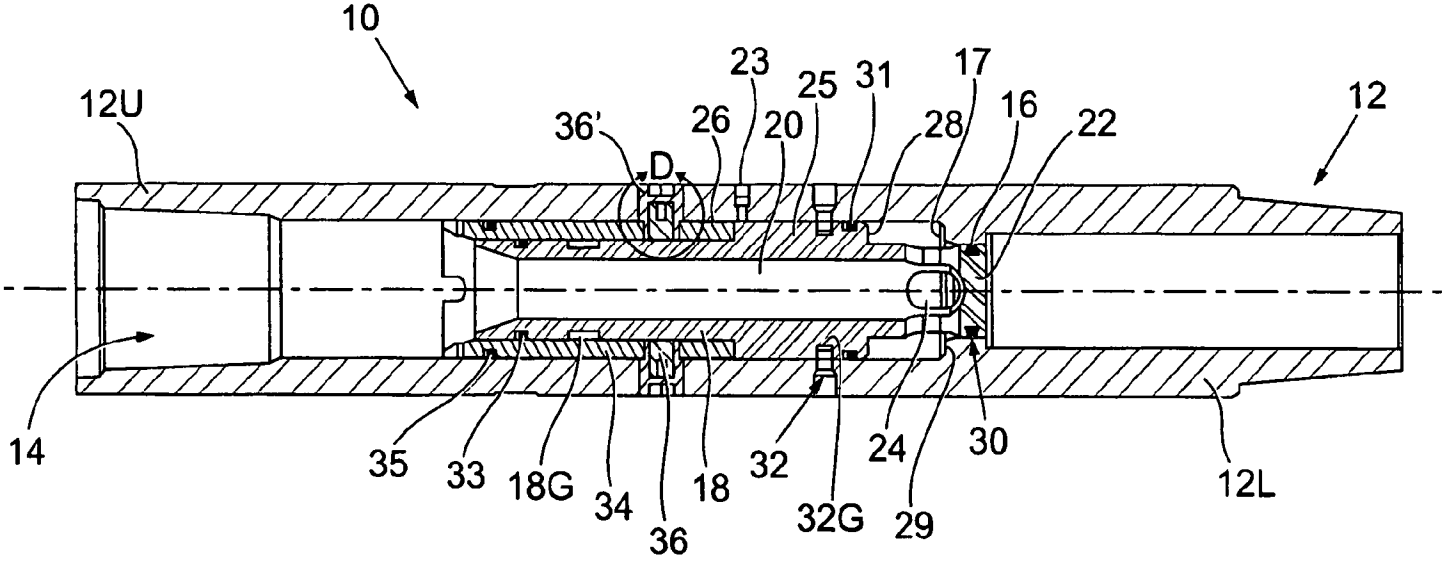
FIG. 1 shows a cross-sectional view of a drillstring isolation valve according to the present invention, the drillstring isolation valve being in a closed position.

Herein, "upper" is defined with respect to the typical orientation of the drillstring isolation valve 10 in use in a vertical borehole, and "lower" is to be construed accordingly. The words "radially inward" and "radially outward" refer to directions defined by the radial axis of the outer tubular body 12.

The bore 14 has a reduced diameter portion 29, which defines a seat 16, and a ledge 17, the purpose of which will be explained later.

The drillstring isolation valve 10 also includes an inner sleeve 18, which is located within the bore 14 of the outer tubular body 12. The inner sleeve 18 has a bore 20, a closed lower end 22, and a radial outlet 24 located in the vicinity of the closed lower end 22. The inner sleeve 18 also has an increased diameter portion 25, part way along its length, which defines an upper shoulder 26 and a lower shoulder 28. The radial outlet 24 is located between the closed lower end 22 and the lower shoulder 28.

The inner sleeve 18 includes a recess in the form of a groove 18G in its outer surface, the groove 18G being located above the upper shoulder 26, towards the upper end of the inner sleeve 18. The groove 18G extends around the circumference of the inner sleeve 18.

The inner sleeve 18 is in a closed position in FIG. 1. In the closed position, a flowpath through the bore 14 is blocked by the closed lower end 22 of the inner sleeve 18, and the closed lower end 22 of the inner sleeve 18 is axially aligned with the seat 16. Fluid cannot get through the bore 14 of the outer tubular from one end 12U to the other end 12L, because the radial outlet 24 is above the seat 16, and because the closed lower end 22 of the inner sleeve is blocking the passage through the seat 16. An o-ring seal 30 is provided around the periphery of the closed lower end 22 of the inner sleeve 18. A further o-ring seal 31 is provided around the periphery of the increased diameter portion 25, and another o-ring seal 33 is provided around the periphery of the inner sleeve 18, near its upper end. The seals 30, 31, 33 help to prevent fluid flow through the annulus between the inner sleeve 18 and the outer tubular body 12 and past the seat 16.

The drillstring isolation valve 10 includes at least one shear pin 32, which holds the inner sleeve 18 fixed relative to the outer tubular body 12 in the closed position. In this embodiment, a plurality of shear pins 32 are provided, located in respective axial apertures in the outer tubular body 12. In the closed position, these axial apertures are aligned with a radial shear pin groove 32G in the inner sleeve 18. The shear pins 32 extend radially inwards of the outer tubular body 12, into the shear pin groove 32G. With the shear pins 32 intact, the inner sleeve 18 cannot move with respect to the outer tubular body 12, and is thus held in the closed position.

The drillstring isolation valve 10 also includes an intermediate sleeve 34 that is fixed to the outer tubular body 12. The intermediate sleeve 34 lies radially between the upper end of the inner sleeve 18 and the outer tubular body 12. The outer diameter of the intermediate sleeve 34 is the same as the outer diameter of the increased diameter portion 25 of the inner sleeve 18, both of which correspond to the inner diameter of the bore 14 of the outer tubular body 12 in the region above the seat 16. The inner diameter of the intermediate sleeve 34 corresponds to the outer diameter of the inner sleeve 18 at its upper end, so that the inner sleeve 18 fits closely within the intermediate sleeve 34. A further o-ring seal 35 is provided around the periphery of the intermediate sleeve 34 in the vicinity of its upper end, to seal the annulus between the intermediate sleeve 34 and the outer tubular body 12.

The intermediate sleeve 34 is permanently fixed to the outer tubular body 12 by a plurality of intermediate sleeve retaining pins 36 (two shown). The intermediate sleeve 34 engages the upper shoulder 26 of the inner sleeve 18, to restrain the inner sleeve 18 against upwards movement beyond the closed position (relative to the intermediate sleeve 34 and the outer tubular body 12).

Each intermediate sleeve retaining pin 36 has a radially outer end 36*a* and a radially inner end 36*b*, "radial" being defined with respect to the outer tubular body 12, not with respect to the intermediate sleeve retaining pin 36.

The intermediate sleeve retaining pins 36 extend through respective bores in the outer tubular body 12 and the intermediate sleeve 34. In this embodiment, the intermediate sleeve retaining pins 36 engage in their respective bores in the outer tubular body 12 by screw threads 38. The bores in the outer tubular body 12 are larger than the bores in the intermediate sleeve 36, and the outer profile of the intermediate sleeve retaining pins 36 have a corresponding step therein, so the outer dimensions of the intermediate sleeve retaining pins 36 match the inner dimensions of the respective bores. The intermediate sleeve retaining pins 36 are each formed with a head adapted to receive a driving tool, e.g. a hex head 40 in their radially outer ends 36*a*, such that they can be screwed into their respective bores in the outer tubular body 12.

The radially inner end 36*b* of each intermediate sleeve retaining pin 36 lies substantially flush with the inner surface of the intermediate sleeve 34, in contact or in close proximity with the outer surface of the inner sleeve 18.

A cylindrical, pin-receiving recess is formed in the radially inner end 36*b* of one of the intermediate sleeve retaining pins 36' (see FIG. 2) and houses an inner sleeve retaining pin 42. Each of the other intermediate sleeve retaining pins 36 has a solid inner end, and does not have a pin-receiving recess. The inner sleeve retaining pin 42 is substantially cylindrical, and has outer dimensions which correspond to the inner dimensions of the pin-receiving recess, except that a step 44 is provided at around half way along the length of the pin 42, the radially outer part of the inner sleeve retaining pin 42 having a smaller diameter than the pin-receiving recess.

Thus, the inner sleeve retaining pin 42 is located adjacent to the outer surface of the inner sleeve 18.

The step 44 provides space for a compression spring 46, which is compressed between the step 44 and the base of the pin-receiving recess. Thus, the compression spring 46 biases the inner sleeve retaining pin 42 in a radially inwards direction, towards and against the inner sleeve 18. In the closed position of FIG. 1, however, the inner sleeve 18 blocks any radially inwards movement of the inner sleeve retaining pin 42.

Figure 3:
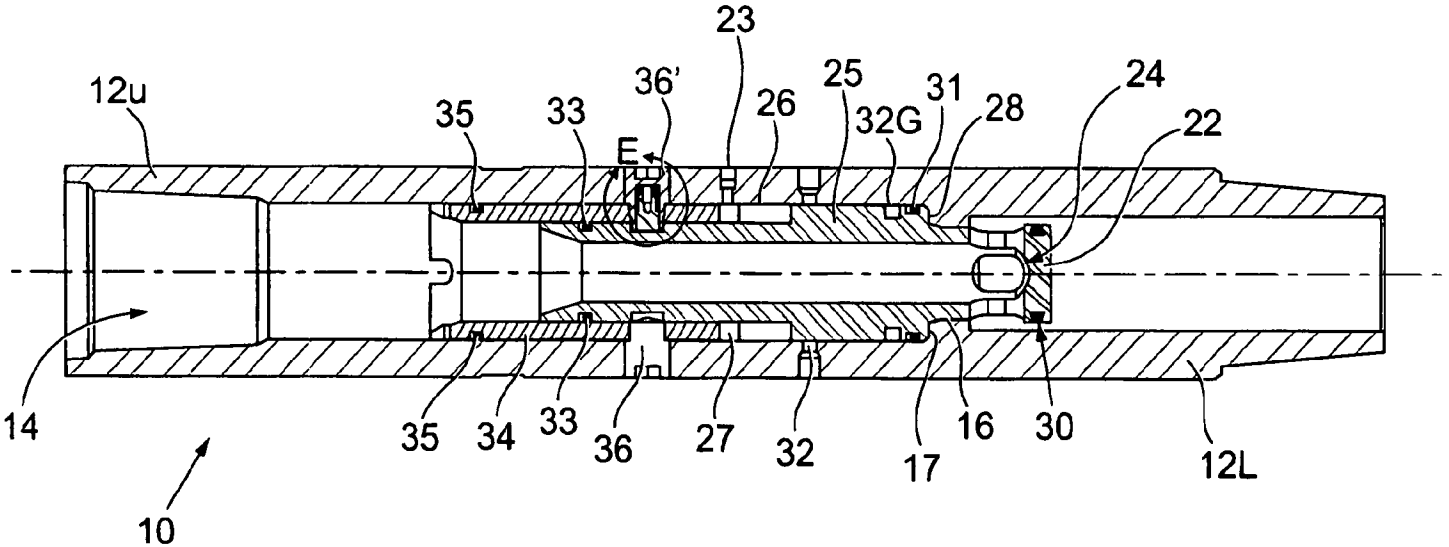
FIG. 3 shows a cross-sectional view of the drillstring isolation valve of FIG. 1 in an open position.
Figure 4:
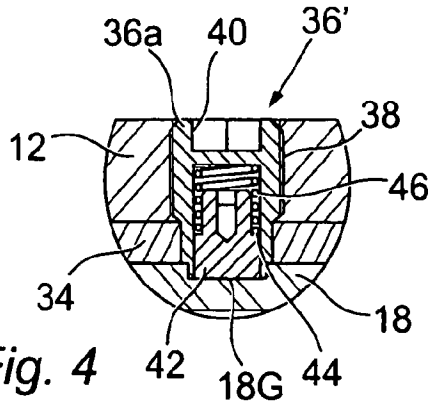
FIG. 4 shows an enlarged view of detail E of FIG. 3.

FIGS. 3 and 4 show the drillstring isolation valve 10 with the inner sleeve 18 in an open position.

During pressurisation, fluid pressure admitted through inlet port 23, and exceeding the design yield point of the shear pins 32 causes the inner sleeve 18 to undergo an axial displacement within the bore 14 to an extent limited by an abutment of a shoulder 28 with a ledge 17 of reduced diameter portion 29 which defines the periphery of seat 16.

Thus the outer tubular body 12 and the intermediate sleeve 34 have not moved, but the shear pins 32 have sheared under applied fluid pressure and the inner sleeve 18 has moved downwards (to the right in FIG. 3) relative to the outer tubular body 12 and the wellbore.

In the open position, the lower end 22 of the inner sleeve 18 has progressed past the seat 16 and the radial outlet 24 is now located beneath the seat 16. Hence, the drillstring isolation valve 10 now provides a flowpath from the upper end 12U of the outer tubular body 12, through the bore 14 of the outer tubular body 12, through the bore 20 of the inner sleeve 18, out of the radial outlet 24 and into the lower end 12L of the outer tubular body 12.

The groove 18G has a width slightly greater than the width of the radially inner end of the inner sleeve retaining pin 42. In the open position, the groove 18G is axially aligned with the inner sleeve retaining pin 42, so that the inner sleeve retaining pin 42 has moved radially inwards under the action of the compression spring 46, thereby retaining the inner sleeve 42 in the open position. Hence, the inner sleeve 18 is prevented from downwards movement beyond the open position by the lower shoulder 28 of the inner sleeve 18 (which now abuts the ledge 17 around seat 16), and by the inner sleeve retaining pin 42. The inner sleeve 18 is prevented from upwards movement beyond the open position by the inner sleeve retaining pin 42.

Figure 5:
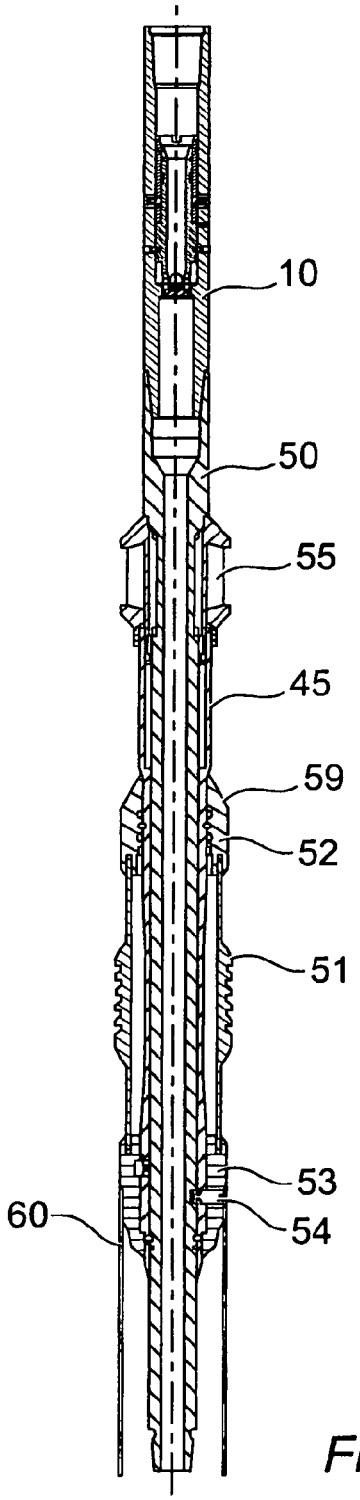
FIG. 5 shows a cross-sectional view of a test assembly comprising an isolation valve and a packer tool in contact with the liner top.

In use, the drillstring isolation valve 10 can be used to test the integrity of an end of a liner and/or casing string in conjunction with a liner top test packer also forming part of the drillstring. The liner top test packer may be a conventional test packer e.g. a weight set packer tool 45 as shown in FIG. 5, and may typically include compressible elastomeric elements 55 located between two plates. The elastomeric elements can be squeezed together, forcing the sides to bulge outwards, to expand the packer for example under a weight setting technique by suitable control of set-down and pick up of the string. The liner top test packer is located in the drillstring such that it will be positionable to close the annulus between the drillstring and the liner 60 (or other casing) for which the liner top seal is to be tested when the drillstring is located in the wellbore.

A suitable packer tool comprises a mandrel 50 with compressible packer element 55, and a stabiliser sleeve 59 with blades 52 which provide a "stand-off" for the tool 45 from the walls of the well bore and a lower torque to the tool 45 during insertion into the well bore.

Located below the stabiliser sleeve 59 is a Razor Back Lantern (Trade Mark) 51. This provides a set of scrapers for cleaning the well bore prior to setting the packer 55. Though scrapers are shown, a brushing tool such as a Bristle Back (Trade Mark) could be used instead or in addition to the scrapers.

A shoulder for operating the compression sleeve of the packer is located on a top dress mill 53 at the lower end of the tool 45. A safety trip button 54 is positioned just below the shoulder.

After the drillstring has been made up to include the isolation valve 10, and a settable packer, which may be included in a specialised liner top test tool as described above, it is run into the cased and lined wellbore. The drillstring above the closed isolation valve has a section of bore which is either free of fluid ("dry") or optionally can be filled with a predetermined amount of fluid of selected physical properties for test purposes according to negative test preliminary calculations (planned operation). The section can contain a gas such as air alone, or can be filled with a fluid comprising a mixture of air and a working fluid.

The liner top test packer is then expanded to seal around setting tool in the tubular string at a selected position proximate to the liner top test site, to seal the annulus between the drillstring and the liner string.

Since the inner sleeve 18 is in the closed position, there is no flowpath through the bore 14 of the outer tubular body 12 of the drillstring isolation valve 10. The sleeve is configured such that areas subject to fluid pressures are appropriately sized such that pressure of fluid in the drillstring below the isolation valve upon run-in and acting upon the leading plug face of lower end 22 of the inner sleeve 18 is normally equal to the pressure in the annulus around the drillstring above the liner top to be tested. However, by suitable pressurisation of the annulus above the liner top in a manner known per se in the art, a pressure difference can be developed if the packer is holding. This developing pressure has a consequence for the drillstring isolation valve 10 by actuation thereof through admission of fluid pressure via the annulus pressure communication port 23 to open the isolation valve by urging the inner sleeve 18 to move and cause the shear pins 32 to yield under the applied shear.

When the shearable pins 32 are thereby forced to yield, permitting the sleeve 18 to move downwardly within the bore 14, a flow path through radial outlets 24 is enabled by emergence of the radial outlets beyond the seat 16 to access the bore below the isolation valve 10. At this point a quantity of air or mixed fluid and air will be displaced upwards from the drillstring above the valve seat. The test may be monitored at the surface by means of a pressure gauge in a side-entry sub (not shown) which may be equipped with a valve and bleed off to release gas/air. Forced gas/air return may be visualised by a bleed off into standing water e.g. a hose tied off and immersed in a water bucket. Prolonged return of air bubbles to surface would indicate an imperfect liner top seal due to overhead fluid penetration.

After the integrity test is completed according to specification, the packer can be unset and recovered on pull out, or fluid circulation may be resumed through the inside of the drillstring from the surface if drilling operations are to be resumed.

Figure 2:
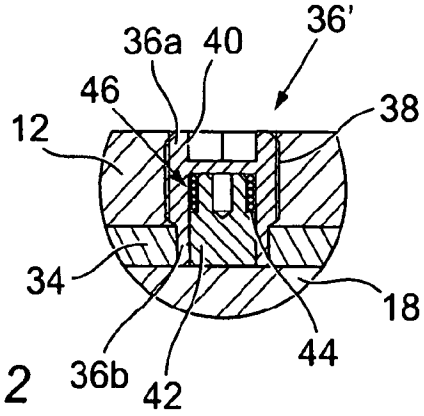
FIG. 2 shows an enlarged view of detail D of FIG. 1.

Referring to FIG. 2 the change in configuration of the drillstring isolation valve upon pressurisation from the annulus will now be described specifically. Fluid pressure delivered to the drillstring isolation valve 10 via port 23 is initially resisted by the retention afforded by the shear pins 32. However, when the designed threshold pressure is reached, the shear pins 32 yield, which allows the inner sleeve 18 to move downwards relative to the intermediate sleeve 34 and the outer tubular body 12. The inner sleeve 18 moves downwards until the lower shoulder 28 of the inner sleeve 18 abuts against the ledge 17 around seat 16 of the outer tubular body 12. The drillstring isolation valve 10 is now in the open position shown in FIGS. 3 and 4 whereby normal circulation flow path is restored.

By this same movement, the inner sleeve retaining pin 42 has now become axially aligned with the groove 18G. Hence, the inner sleeve retaining pin 42 moves radially inwards into the groove 18G, under the action of the compression spring 46, which expands. The inner sleeve retaining pin 42 now restricts or prevents both upwards and downwards movement of the inner sleeve 18 with respect to the outer tubular body 12, to retain the drillstring isolation valve 10 in the open position. So, the inner sleeve 18 is now prevented from further downwards movement beyond the open position by the seat 16 and by the inner sleeve retaining pin 42. The inner sleeve 18 is prevented or restricted from upwards movement beyond the open position by the inner sleeve retaining pin 42.

In the open position, the radial outlet 24 is now below the seat 16. Fluid can flow through the drillstring isolation valve 10 via the upper end of the outer tubular body 12, the bore 14, the bore 20 of the inner sleeve 18, the radial outlet 24 and the lower end of the outer tubular body 12. Hence, an axial flowpath now exists through the inside of the drillstring. The packer can be deflated if required, and the drillstring can be used as normal (for example, fluid may be run into the hole through the drillstring). Alternatively, the drillstring may be pulled out of the hole.

In an illustrative use of an embodiment, a drillstring incorporating an operative assembly of the drillstring isolation valve 10 and a liner top test tool with packer (FIG. 5), and optionally equipped with a top dress mill (not shown) for removing burrs and the like from the liner top, is run in hole with no fluid communication through the closed valve to the drillstring below.

The drill string above the closed valve may be "dry" i.e. air-filled, or optionally contain a predetermined fluid volume of a density selected according to negative test preparatory calculations as the string is run in hole. Typically the tool is run in "dry" to a selected location near the liner top to be dressed and tested. Normal procedures are followed on approach to landing on the liner top according to industry practice and operator protocols and specifications. The test tool packer may be weight set according to recognised practice. A suitable liner top test tool with packer and top dress mill is described in U.S. Pat. No. 6,896,064 which is hereby incorporated by reference. However use of other removable packing elements is possible.

The annulus above the liner is closed off and secured for pressurisation e.g. using typical surface annular blow-out preventers. The isolation valve is opened under application of increased fluid pressure from the surface to the annulus above the liner top. A significant draw-down pressure is thereby achieved due to the increased pressure differential between well working fluid in the annulus above the liner top and fluid in the annulus beneath the liner top under test.

Having established the integrity of the liner top packer by completing the usual inflow test according to specification, the pressures can be equalised by introducing drilling fluid (mud) and using the mud pump to pressure up to normal circulation/drilling fluid operational pressures. The tool can be recovered by pick up to unset the packer as is known in the art.

The invention claimed is:

1. A tubular isolation valve comprising:

an outer tubular body adapted to attach to a work string, the outer tubular body having an axial through bore; and an inner sleeve, located within the bore of the outer tubular body;

wherein the inner sleeve is selectively moveable within the bore relative to the outer tubular body between a closed position, in which there is no flowpath through the bore of the outer tubular body, and an open position, in which the tubular isolation valve provides a flowpath through the bore of the outer tubular body, wherein said inner sleeve is moveable at a predetermined pressure, and at least one side port is provided in the outer tool body to admit fluid pressure from the annulus around the work string in use to cause release of the inner sleeve from its closed position, and move it to the open position to thereby open flow communication through the work string.

2. The tubular isolation valve as claimed in claim 1, wherein the tubular isolation valve includes at least one shear pin, which holds the inner sleeve fixed relative to the outer tubular body in the closed position and which is shearable to allow the inner sleeve to move to the open position at said predetermined pressure.

3. The tubular isolation valve as claimed in claim 2, wherein the shear pin is arranged to be sheared in response to fluid pressure acting on the inner sleeve.

4. The tubular isolation valve as claimed in claim 1, wherein the inner sleeve has a blind bore such that the inner sleeve is closed axially at one end and at least one radial outlet is located in the vicinity of the closed one end.

5. The tubular isolation valve as claimed in claim 4, wherein the inner sleeve has a shoulder on a surface thereof, and the radial outlet is located between the closed one end of the inner sleeve and said shoulder of the inner sleeve.

6. The tubular isolation valve as claimed in claim 5, wherein the outer tubular body has a seat configured to abut the shoulder of the inner sleeve when the tubular isolation valve is in the open position.

7. The tubular isolation valve as claimed in claim 6, wherein the seat comprises a reduced diameter portion of the bore of the outer tubular body, and the shoulder is provided by an increased diameter portion of the inner sleeve.

8. The tubular isolation valve as claimed in claim 6, wherein, when the inner sleeve is in the closed position, the radial outlet is located between the shoulder of the inner sleeve and the seat of the outer tubular body, and in the open position, the radial outlet is located past the seat and opening into a further section of bore of the outer tubular body.

9. The tubular isolation valve as claimed in claim 6, wherein, in the closed position, a seal is located between the inner sleeve and the seat to prevent fluid flow around the outside of the inner sleeve and past the seat.

10. A tubular isolation valve comprising:

an outer tubular body adapted to attach to a work string, the outer tubular body having an axial through bore, said through bore having a reduced diameter portion defining a valve seat and a ledge; and an inner sleeve, located within the bore of the outer tubular body, and having a closed end configured to seal within the valve seat, and a shoulder spaced from that closed end, and having a radial outlet in the sleeve positioned between the shoulder and the closed end;

wherein in use the inner sleeve is selectively moveable within the bore relative to the outer tubular body between a closed position, in which said closed end is in sealing abutment with the valve seat, and the shoulder is spaced from the ledge, and there is no flowpath through the bore of the outer tubular body, and an open position, in which the shoulder is in abutment with the ledge, and the closed end is positioned beyond the valve seat to expose the radial outlet to the throughbore beyond the valve seat, whereby the tubular isolation valve provides a flowpath through the bore of the outer tubular body, and wherein said inner sleeve is moveable at a predetermined pressure.

11. The tubular isolation valve as claimed in claim 10, wherein the tubular isolation valve also includes an inner sleeve retaining pin, which is located adjacent to the outer surface of the inner sleeve and is spring biased in a radially inward direction towards the inner sleeve.

12. The tubular isolation valve as claimed in claim 11, wherein the inner sleeve includes a recess in its outer surface, the recess being axially aligned with the inner sleeve retaining pin in the open position, such that, when the open position is reached, the inner sleeve retaining pin is spring urged into engagement with the recess, thereby retaining the inner sleeve in the open position.

13. The tubular isolation valve as claimed in claim 10, also including an intermediate sleeve that is fixed to the outer tubular body.

14. The tubular isolation valve as claimed in claim 13, wherein the intermediate sleeve engages a shoulder of the inner sleeve when the inner sleeve is in the closed position.

15. The tubular isolation valve as claimed in claim 13, wherein the tubular isolation valve also includes an inner sleeve retaining pin, which is located adjacent to the outer surface of the inner sleeve and is spring biased in a radially inward direction towards the inner sleeve, and wherein the inner sleeve retaining pin is located within a socket of a retaining pin of the intermediate sleeve, the retaining pins of the intermediate sleeve permanently fixing the intermediate sleeve to the outer tubular body.

16. A method of testing the integrity of a seal between a liner top and a casing string of a wellbore, comprising the steps of:

providing a tubular string including a tubular isolation valve and a settable liner test tool including a packer;

running the tubular string into the wellbore with the tubular isolation valve in a closed position in which there is no flowpath through the bore of the tubular isolation valve;

setting the packer in an annulus of the wellbore between the tubular string and the casing or liner to allow the seal of the packer to be tested; and pressurising the annulus above the seal of the packer to be tested using a fluid, and using pressure developed in the annulus above the seal of the packer to open the isolation valve and establish a flowpath through the tubular into the annulus below the seal of the packer to be tested.

17. The method as claimed in claim 16, wherein a tubular bore section in the tubular string above the tubular isolation valve contains a first fluid of predetermined properties which consists of a gas, or a gas-containing fluid mixture.

18. The method as claimed in claim 16, wherein the tubular isolation valve comprises:

an outer tubular body adapted to attach to a work string, the outer tubular body having an axial through bore; and an inner sleeve, located within the bore of the outer tubular body;

wherein the inner sleeve is selectively moveable within the bore relative to the outer tubular body between a closed position, in which there is no flowpath through the bore of the outer tubular body, and an open position, in which the tubular isolation valve provides a flowpath through the bore of the outer tubular body, wherein said inner sleeve is moveable at a predetermined pressure.

19. The method as claimed in claim 16, wherein movement of the inner sleeve is enabled by pressurising an annulus around the outer tubular body of the tubular isolation valve to a predetermined pressure at which said inner sleeve is moveable.

20. The method as claimed in claim 19, wherein the tubular isolation valve is retained in the open position by at least one retaining pin that is coupled to the outer tubular body, and which engages in a recess in the outer surface of the inner sleeve.

21. The method as claimed in claim 16, wherein the annulus around the tubular string within the liner of the wellbore is sealed by a packer at or above a liner hanger.

22. The method as claimed in claim 16, wherein for the step of pressurising the annulus of the wellbore, the annulus is sealed at surface by a BOP, and at the liner by a packer carried by a tubular sub.

23. The method as claimed in claim 16, wherein the tubular forms part of a drillstring.

24. A method of pressure testing the integrity of a downhole liner top assembly in a wellbore using a work string including a tool assembly having a throughbore and comprising an isolation valve adapted to close the throughbore and a packer, the method comprising:

running the tool assembly with the isolation valve in a closed position into the wellbore to the liner top assembly to be tested, positioning and setting the packer to close an annulus within the wellbore and around the work string below the packer, and increasing fluid pressure in the annulus above the packer to cause opening of the isolation valve and permit fluid flow in the throughbore.

25. A tubular isolation valve comprising:

an outer tubular body adapted to attach to a work string, the outer tubular body having an axial through bore; and an inner sleeve, located within the bore of the outer tubular body;

wherein the inner sleeve is selectively moveable within the bore relative to the outer tubular body between a closed position, in which there is no flowpath through the bore of the outer tubular body, and an open position, in which the tubular isolation valve provides a flowpath through the bore of the outer tubular body, wherein the inner sleeve is moveable at a predetermined pressure, the inner sleeve has a blind bore such that the inner sleeve is closed axially at one end, has a shoulder on a surface thereof, and has a radial outlet located between the closed one end of the inner sleeve and the shoulder of the inner sleeve, the outer tubular body has a seat configured to abut the shoulder of the inner sleeve when the tubular isolation valve is in the open position, and when the inner sleeve is in the closed position, the radial outlet is located between the shoulder of the inner sleeve and the seat of the outer tubular body, and in the open position, the radial outlet is located past the seat and opening into a further section of bore of the outer tubular body.

* * * * *